United States Patent [19]

Abbin, Jr. et al.

[11] 4,266,107

[45] May 5, 1981

[54] ACCELERATION SWITCH

[75] Inventors: Joseph P. Abbin, Jr.; John N. Middleton; Harold E. Schildknecht, all of Albuquerque, N. Mex.

[73] Assignee: The United States of America as represented by the United States Department of Energy, Washington, D.C.

[21] Appl. No.: 67,858

[22] Filed: Aug. 20, 1979

[51] Int. Cl.[3] ..... H01H 35/14

[52] U.S. Cl. ..... 200/61.53

[58] Field of Search ..... 200/61.45 R, 61.53; 73/493, 503, 521, 522

[56] References Cited

U.S. PATENT DOCUMENTS

| | | | |
|---|---|---|---|
| 2,993,100 | 7/1961 | Maeder | 73/503 X |
| 3,217,121 | 11/1965 | Hradek et al. | 200/61.53 |
| 3,227,834 | 1/1966 | Keese | 200/61.45 |

*Primary Examiner*—James R. Scott

*Attorney, Agent, or Firm*—George H. Libman; Dudley W. King; James E. Denny

[57] ABSTRACT

The disclosure relates to an improved acceleration switch, of the type having a mass suspended within a chamber, having little fluid damping at low g levels and high fluid damping at high g levels.

8 Claims, 4 Drawing Figures

ACCELERATION SWITCH

FIELD OF THE INVENTION

The invention relates to an acceleration-sensitive switch employing a movable mass, the motion of which is opposed by a spring and damped by a fluid.

BACKGROUND OF THE INVENTION

Accelerometers, acceleration switches, and inertial sensing devices are widely used to measure accelerations (forces resulting from vibrations, changes in velocity, or the like). Such devices may include some sort of sensing mass suspended within the device so as to be affected by acceleration forces so as to move and thereby open or close an electrical contact. The acceleration switch may be filled with damping fluid so as to prevent premature opening or closing of the switch due to vibration, shocks, or the like. Examples of such acceleration switches are illustrated in U.S. Pat. Nos. 2,997,883, 3,096,411 and 3,715,535.

When an acceleration switch is used to generate a timing signal, it may be necessary to provide a very precisely timed output. For example, in a reentry vehicle such as might be used in entering the earth's atmosphere, it may be desirable to know within milliseconds the precise moment when a preset acceleration level is reached. If the movement of the mass is damped by fluid, an unacceptable lag may occur in closing the switch. On the other hand, if the mass is undamped, vibration or shock may close the switch prematurely.

In order that the mass move relatively freely within the device, low friction bearings such as ball bearings have been employed in the suspension of the mass. Such bearings may be relatively weak and may break upon heavy lateral shock loading; thus preventing reliable switch operation.

SUMMARY OF THE INVENTION

In view of the difficulties and disadvantages as noted above, it is an object of this invention to provide a novel apparatus for measuring or sensing acceleration.

It is a further object of this invention to provide an acceleration switch which very precisely signals the moment when a preset acceleration level is reached yet is insensitive to extraneous shocks even higher than the preset level.

It is a still further object of this invention to provide an acceleration switch which is rugged and withstands high shock levels so as to survive and be sensitive to the desired acceleration levels.

The invention comprises an improved acceleration switch having a mass or piston suspended within a fluid-filled case and biased against motion by a reset spring. Upon acceleration in the desired longitudinal direction, the mass tends to move to close an electrical circuit. Under high g loading, an orifice within the piston closes causing increased braking or damping by the fluid so as to prevent premature actuation of the switch. The mass is suspended by ball bearing wheels which are retractable so as to be protected during high lateral acceleration.

BRIEF DESCRIPTION OF THE DRAWINGS

Other objects and advantages of the present invention will be apparent to those skilled in the art from the following description with reference to the appended claims wherein like numbers denote like parts and wherein:

DESCRIPTION OF THE PREFERRED EMBODIMENT

Figure 1:
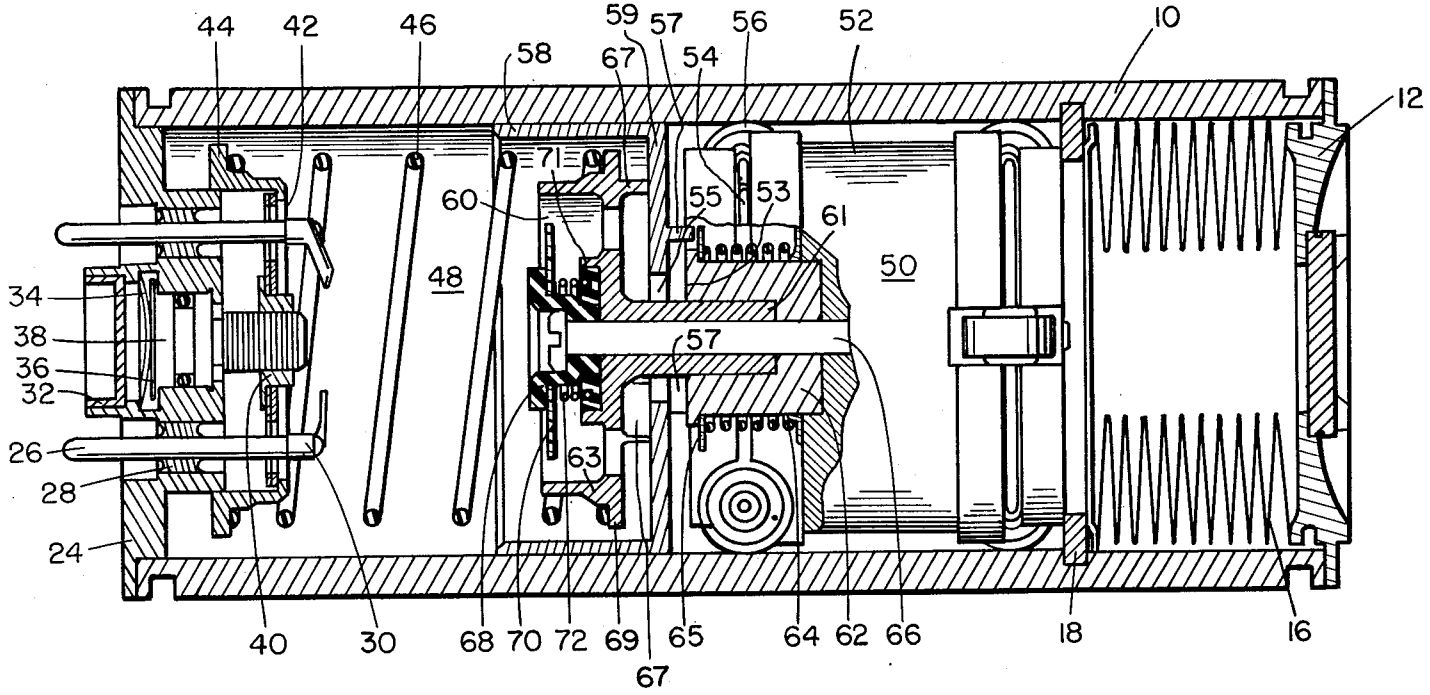
FIG. 1 illustrates in cross section an exemplary embodiment of the invention.

Reference is now made to FIGS. 1 and 2 which illustrate the apparatus of the invention. Described generally, the acceleration switch of the present invention is shown comprising a cylindrical case or tubular housing 10 having a first end closure 12 and a second end closure 24. Contained within the cylindrical case is damping fluid 48 and carriage assembly 50. The carriage assembly is longitudinally movable under acceleration or "set back" forces. This movement is opposed by helical reset spring or spring member 46 and damped by the flow of damping fluid 48.

As the acceleration increases above a minimum, the carriage assembly tends to move away from end 12 of the case towards 24, other end compressing the spring. At a predetermined level of acceleration, shorting ring 70 carried by the piston assembly closes an electrical circuit between the two electrical contacts 30.

As more fully described hereinafter, at accelerations below a preset second level, fluid is free to flow through and around the piston assembly; above this preset level this flow is greatly restricted. The purpose of this restrictive action is to prevent actuation by a momentary extremely high acceleration pulse.

Described more particularly the acceleration switch depicted in FIGS. 1 and 2 comprises a normally open switch which closes when subjected to a longitudinal acceleration of 15 g. The exemplary embodiment is about 1 inch in diameter, 2.4 inches long and weighs about 0.375 pounds. The exemplary embodiment comprises a cylindrical case 10 welded closed on either end by end closures to provide a hermetic enclosure. Next to the first end closure 12 is a gas filled accumulator bellows 16 which accommodates thermal expansion or contraction of damping fluid 48 as well as compensating for some possible loss of fluid over the life of the unit. The bellows also makes the operation of the switch more predictable by eliminating the need for a vapor bubble in the damping fluid (to accommodate fluid expansion due to temperature) and its associated effects on fluid metering and buoyant forces on the piston.

The other end of the cylindrical case is closed by second end closure 24. This end closure is penetrated by two electrical terminals 26 which are sealed to the end with a glass-to-metal seal 28 and which have electrical contacts 30 within the switch cavity.

Housed with the switch cavity is piston carriage assembly 50. At rest, this piston assembly is urged against a first retaining ring 18 by helical reset spring 46. In order to compensate for performance variations with changes in temperature, instead of resting against end 24, one end of this spring rests against an adjustable spring retainer 44. The position of this adjustable spring retainer is varied by the response of bimetallic disc 42 to the ambient temperature. During final assembly, the switch may be "fine tuned" by proper adjustments of jack screw 38 which is coupled to end 24 and to the bimetallic disc through threaded hub 40. After final adjustment, the jack screw is locked and sealed with split washer 36, second retaining ring 34, and weld plug 32.

The carriage assembly 50 comprises a generally cylindrical inertial sensing mass 52 which is free to move longitudinally within the cylindrical case. Circumferentially spaced around this mass are eight wheels 56 on two ring-shaped axles 54 to provide rolling contact between the mass and the walls of the case. Each wheel is actually a conventional ball bearing assembly with its outer race acting as the wheel rim. To protect the wheels from mechanical damage if mass 52 is subjected to intensive lateral acceleration, each axle is deflectable so that any wheel can be depressed into a corresponding recess in the mass and the additional lateral force is taken up by direct contact between the wall of the case and the mass.

As illustrated in FIG. 1, slidably attached to mass 52 and guide 60 by bolt 66 are insulator 68 and piston 58.

Guide 60 has a tubular shaft or center portion 61 affixed to support 62 of mass 52 and transverse spokes extending from one end thereof to annulus 63. Three arcuate tabs 67, two of which are visible in FIG. 1, space annulus 63 from web 59 of piston 58 and permit the unimpeded flow of fluid 48 therebetween. Outer ring portion 69 of annulus 63 provides a bearing surface for reset spring 46.

One end of cylindrical insulator 68 is a transverse ring 71 centered over portion 61 of guide 60 by the head of bolt 66. The other end includes an annular lip which provides a bearing surface for electrically conductive shorting ring 70. Spring 72 extends from ring 71 to bias shorting ring 70 against the bearing surface. When piston assembly 50 approaches end 24 of the switch, shorting ring 70 touches contacts 30 to close the switch.

Shaft support 62 of mass 52 has outer surface 53 of greater diameter than its cylindrical body, forming a lip against which washer 65 is biased by spring 64. Three tabs 57 (two of which are shown in FIG. 1) extend from web 59 of piston 58 to contact washer 65. Web 59 has aperture 55 through which center portion 61 is fitted, the diameter of aperture 55 being less than the diameter of surface 63. Under normal conditions, fluid 48 passes piston 58 either through the small clearance gap between piston 58 and case 10 (typically 2.6 mil) or through the interior passage at aperture 55, the cross-sectional area of the interior passage being about six times that of the clearance gap. On an abnormal increase in acceleration sufficient to overcome the resistance of piston spring 64, web 59 translates against surface 63 to effectively stop fluid flow through the interior passage. This valve action produces a marked increase in the resistance to the flow of fluid and brakes the movement of the piston assembly.

Figure 2A:
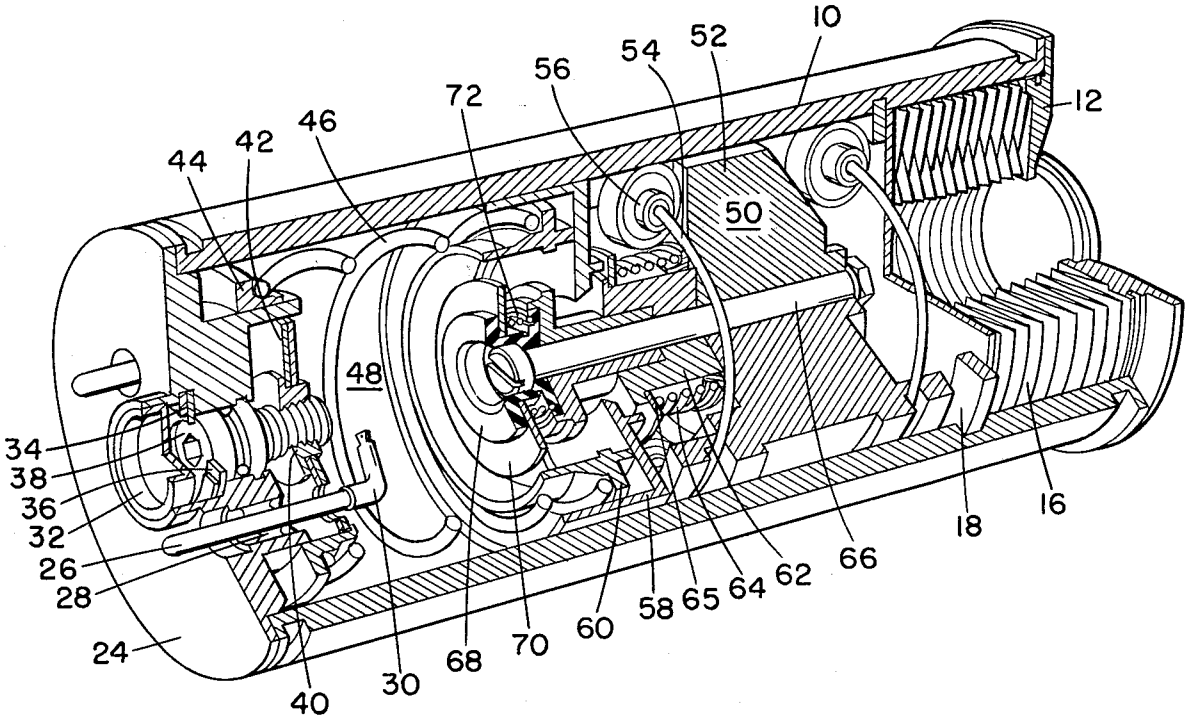
FIGS. 2*a* and 2*b* illustrate in perspective an exemplary embodiment of the invention in open and closed positions respectively.
Figure 2B:
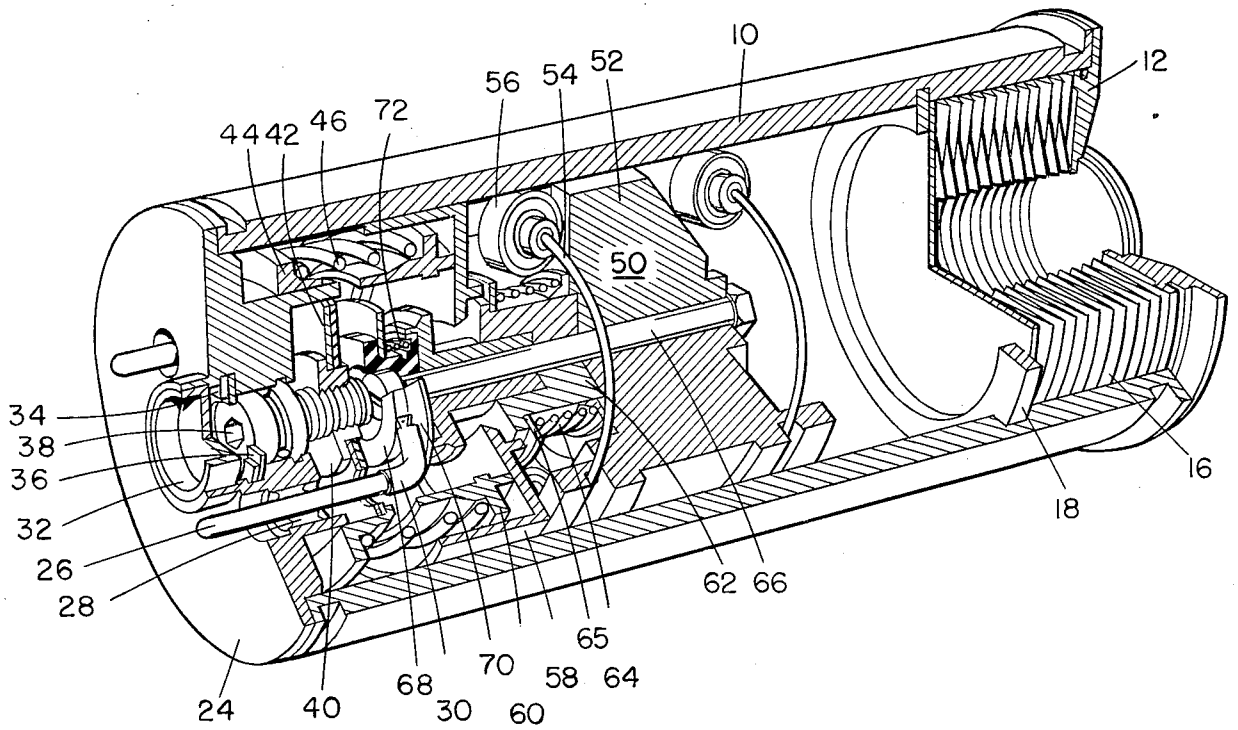

The open and closed positions of the switch can be seen in FIGS. 2*a* and 2*b*.

Figure 3:
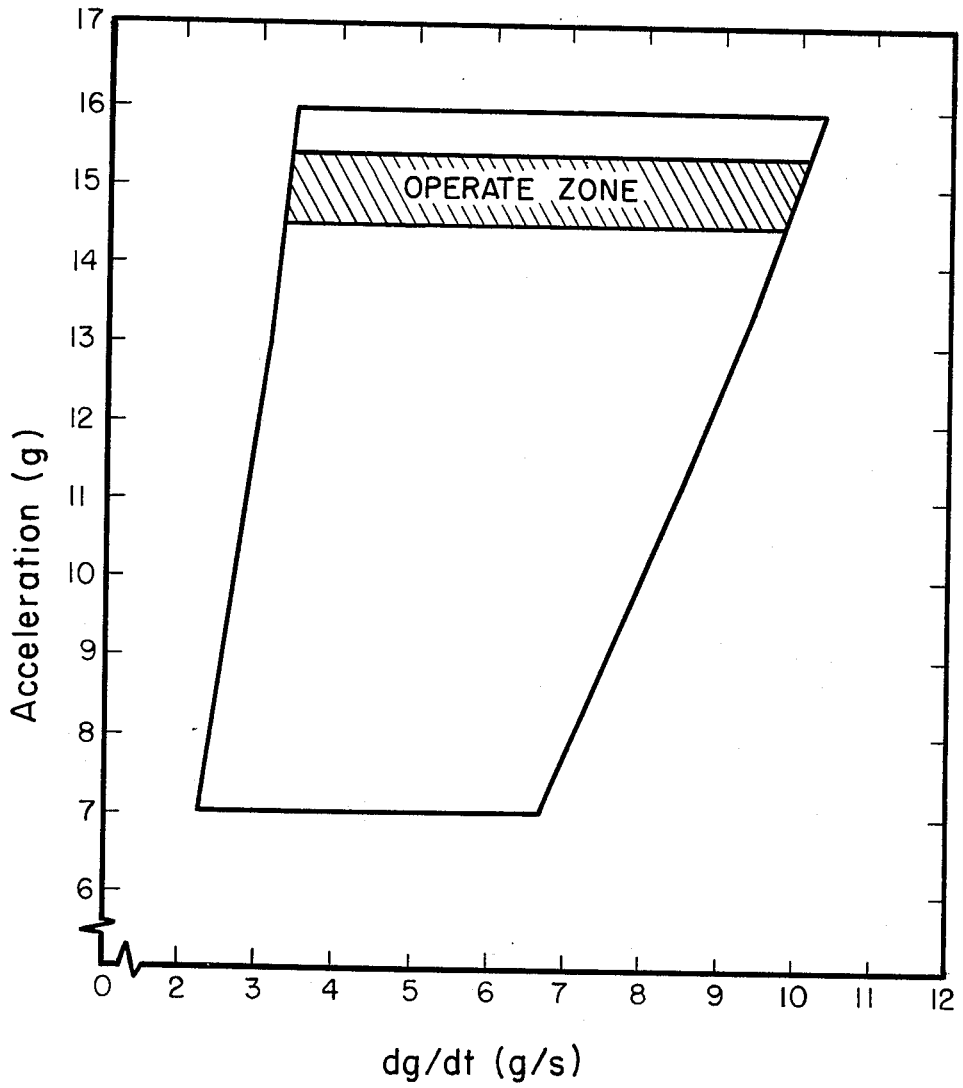
FIG. 3 illustrates the operating envelope of an exemplary embodiment of the invention.

Reference is now made to FIG. 3 which illustrates the operating envelope of the exemplary embodiment. This switch has had an exceptionally high accuracy, operating at 15 g±3% when subjected to conditions shown within the envelope.

This acceleration switch may be employed in a reentry vehicle or the like. During reentry, the reentry vehicle may be subjected to rapidly increasing longitudinal accelerations, severe lateral accelerations, and momentary extremely high longitudinal g-shocks. For timing purposes, it may be desirable to be able to precisely determine when the longitudinal g-force exceeds a preset amount (and when this force no longer exceeds this amount). In operating, the piston assembly will begin to move when the longitudinal acceleration is approximately 7 g. The carriage assembly will be displaced linearly down the bore of the case, making electrical contact when an acceleration of 15 g is reached. As long as the acceleration remains within the desired envelope, fluid damping is kept at a minimum and there is minimal lag in the operation of the switch. Should there be a momentary high g pulse with a peak value higher than the normal operating point the aforementioned valve action, damping to be greatly increased so as to prevent premature actuation.

The acceleration switch of this invention will operate reliably during exposure to 10 g lateral acceleration. While in its actuated position, the switch will perform reliably during exposure to a composite acceleration of 85 g longitudinal in the direction to cause operation and 200 g lateral in any direction. Before and after operation, the switch may experience longitudinal shocks up to 950 g and lateral shocks up to 750 g and still operate reliably.

The various features and advantages of the invention are thought to be clear from the foregoing description. However, various other features and advantages not specifically enumerated will undoubtedly occur to those versed in the art, as likewise will many variations and modifications of the preferred embodiment illustrated, all of which may be achieved without departing from the spirit and scope of the invention as defined in the following claims.

We claim:

1. An acceleration sensitive switch comprising a generally tubular housing forming a chamber; a damping fluid within said chamber; an electrical contact within said chamber; a carriage assembly longitudinally moveable within said chamber including an inertial sensing mass and a piston having valve means for controlling the flow of said fluid past said piston, said valve means being open only when the acceleration of said switch is less than a second predetermined level and closed only when the acceleration is greater than said level; and spring means for biasing said carriage assembly away from said contact when the acceleration of said switch is zero, the force of said carriage assembly overcoming the bias of said spring when the acceleration of said switch exceeds a first predetermined level, the second level being greater than the first level.

2. The switch as claimed in claim 1, wherein said valve means comprises a centrally disposed shaft carried by said mass and extended through an aperture in said piston and a second spring encircling said shaft, said second spring urging said piston away from said mass when the acceleration of said switch is less than the second level.

3. The switch as claimed in claim 2, wherein the cross-sectional area of the fluid path within said open valve means is about six times the area of the fluid path between said piston and said tubular housing.

4. The switch as claimed in claim 2, wherein said piston includes a web extending from the aperture to adjacent said tubular housing, and said mass includes a shaft support having a surface opposed said web at the aperture, said web and said surface touching to prevent the passage of damping fluid through the aperture when the acceleration of said switch exceeds the second level.

5. The switch as claimed in claim 1, wherein at least a single axle extends circumferentially about said mass, and a plurality of roller bearings are carried by said axle and normally support said carriage for movement along said tubular housing.

6. The switch as claimed in claim 5, wherein said axle is transversely yieldable in response to transverse accelerations of said switch for effecting direct support of said carriage assembly against said tubular housing.

7. The switch as claimed in claim 5, wherein said mass is provided with circumferentially spaced recesses, said roller bearings are housed within said recesses, and said axle is transversely yieldable in response to transverse accelerations of the switch for effecting movement of the roller bearings into said recesses and direct support of said carriage assembly against said tubular housing.

8. The switch as claimed in claim 1, wherein a pair of axles spaced from each other longitudinally each extend circumferentially about said mass, and a plurality of roller bearings are carried by each axle and normally support said carriage for movement along said tubular housing.

* * * * *